United States Patent [19]

Dunn

[11] Patent Number: 4,527,794

[45] Date of Patent: Jul. 9, 1985

[54] WIND RESISTANCE EXERCISE DEVICE

[76] Inventor: Joseph P. Dunn, 3455 Atwater Ct., Freemont, Calif. 94536

[21] Appl. No.: 466,884

[22] Filed: Feb. 16, 1983

Related U.S. Application Data

[63] Continuation-in-part of Ser. No. 406,193, Aug. 9, 1982, abandoned.

[51] Int. Cl.[3] ..... A63B 21/00

[52] U.S. Cl. ..... 272/70; 272/DIG. 9; 280/810; 244/151 A

[58] Field of Search ..... 272/70, 70.3, 70.4, 272/71, DIG. 9, 73, 130; 280/213, 810; 244/142, 153, 143, 154, 151 R, 156, 152; 114/102, 103, 39; D12/321; 224/153, 154, 156, 265, 201

[56] References Cited

U.S. PATENT DOCUMENTS

| | | | |
|---|---|---|---|
| 2,018,062 | 10/1935 | Hardt | 280/810 |
| 2,213,754 | 9/1940 | Thirring | 280/810 |
| 3,464,607 | 9/1969 | Grace | 224/156 |
| 3,768,823 | 10/1973 | Goldberg | 280/810 |
| 3,830,512 | 8/1974 | Spiegel | 280/810 |

FOREIGN PATENT DOCUMENTS

| | | | |
|---|---|---|---|
| 102888 | 5/1899 | Fed. Rep. of Germany | 280/213 |
| 2310563 | 9/1974 | Fed. Rep. of Germany | 280/810 |
| 1499954 | 9/1967 | France | 280/810 |
| 492784 | 9/1937 | United Kingdom | 280/810 |

*Primary Examiner*—Richard J. Johnson

*Attorney, Agent, or Firm*—Bielen and Peterson

[57] ABSTRACT

A training device, especially useful for a runner utilizing a flexible frame member which is attached to the runner and may be deformed by the runner while in motion.

8 Claims, 3 Drawing Figures

WIND RESISTANCE EXERCISE DEVICE

BACKGROUND OF THE INVENTION

The present application is a continuation-in-part of my patent application Ser. No. 406,193, filed: Aug. 9, 1982 now abandoned.

The present invention relates to a novel and useful device which may be used to obtain runners, walkers, cyclists, and other persons in motion.

In the past, a person training to attain a physical standard was required to run, walk, pedal, or otherwise move over a certain distance within a certain time period. Unfortunately, many persons in training are restricted by the limits of the training area. For example, a certain body of water or a certain running track is all that is available for the user. A training device which permits the user to utilize a restricted training area and yet obtain the necessary exercise would be a great advance in the art of athletics.

SUMMARY OF THE INVENTION

In accordance with the present invention, a novel and useful training device for dynamic exercising is provided.

The training device of the present invention utilizes a frame member and an air foil which is held to the frame member. The frame member is attached to the user such that it trails the user while in motion.

Such attachment means may include an attachment member which affixes to the frame and air foil and which connects to the user such that a portion of the air foil lies on either side of the attachment member. If the attachment member fixes to the waist area of the user, then a portion of the air foil may be located above and below the waist. The attachment means may also include a bracket which holds the frame to the shoulder of the user.

The training device of the present invention may also embrace means for diverting air from the air foil. Such means may take the form of slits which are open or closed by zippers or like mechanisms.

The air foil of the training device of the present invention may externalize in a first air foil and a second air foil such that the first air foil lies between the user and the second air foil. The first air foil may also include an adjustable orifice which permits air to travel to the second air foil in desired quantities.

The training device may take the form of simply a flexible frame member which may be constructed of a flexible tubular material. Means would be provided for attaching the flexible frame member to the user and means would be provided for permitting the user to deform the flexible frame member while in motion. This embodiment of the device would permit the user to exercise his legs and arms at the same time. Needs for attaching the frame member may include a yoke which partially surrounds the user and first and second legs connected to the yoke. First and second legs would also connect to the first and second end portions of the flexible tubular member. Handles may be attached to the flexible tubular member to permit the user to push or pull to deform the flexible member. An air foil may also be attached to this frame member such that it trails the user while he is in motion.

It may be apparent that a novel and useful training device has been described.

It is an object of the present invention to provide a training device which permits the user to utilize a restricted training environment and yet obtain the desired level of exercise.

It is another object of the present invention to provide a training device which may be easily carried by the user and includes means for adjusting the effect of the training device on the user.

It is yet another object of the present invention to provide a training device which created a resistance on the user but is simple and easy to employ.

Is another object of the present invention to provide a training device which permits the user to exercise his arms and legs at the same time.

It is still another object of the present invention to provide a training device which is partially collapsible such that the user may pass through confined areas while in motion.

The invention possesses other objects and advantages, especially as concerns particular characteristics and features thereof which become apparent as the specification continues.

For a better understanding of the invention references is made to the following detailed description.

DESCRIPTION OF THE PREFERRED EMBODIMENTS

Various aspects of the present invention will evolve from the following detailed description of the preferred embodiments thereof, which should be taken in conjunction with the heretofore described drawings.

Figure 1:
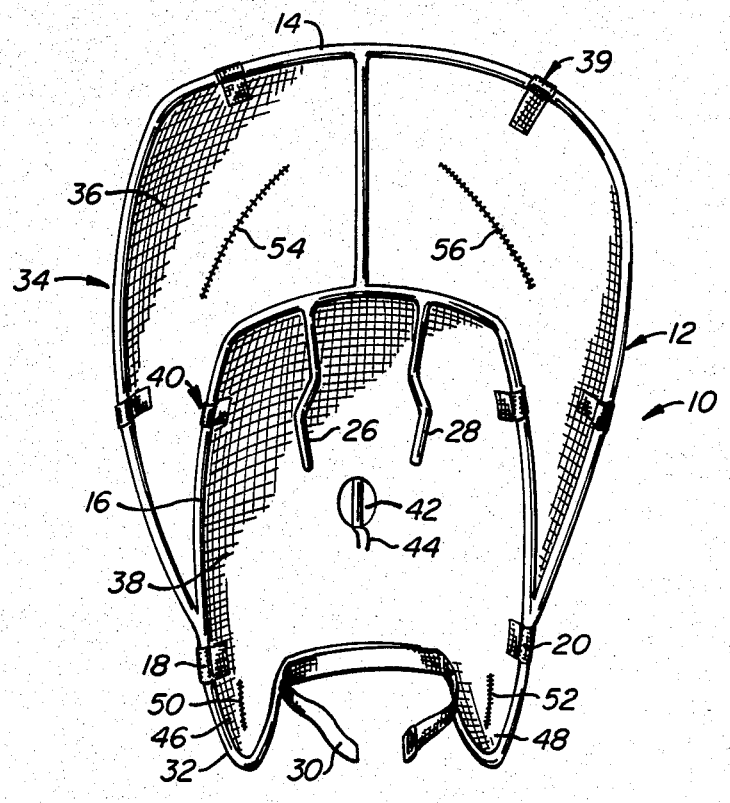
FIG. 1 is a front elevational view of the device.

With reference to the drawings, FIG. 1 shows the device of the present invention and is identified herein by reference character 10. Device 10 includes a frame member 12 which may be constructed of any light weight and rigid, or semi-rigid material such as aluminum, fiberglass, and the like. Frame member may include a first hoop 14 and a second hoop 16. Hoop 14 and 16 attach to one another at connection points 18 and 20. Frame 12 includes means 22 for attaching frame 12 to a user 24, FIG. 2. Means 22 is depicted on FIGS. 1 and 2 as a pair of brackets 26 and 28 which fit over shoulders of user 24. Brackets 26 and 28 are extensions of hoop 16 but may be formed separately and be connected to other portions of frame 12. Means 22 may also include a belt strap 30 which buckles around the waist of the user. It may be seen that a portion 32 of frame 12 extends below the waist of user 24.

Figure 2:
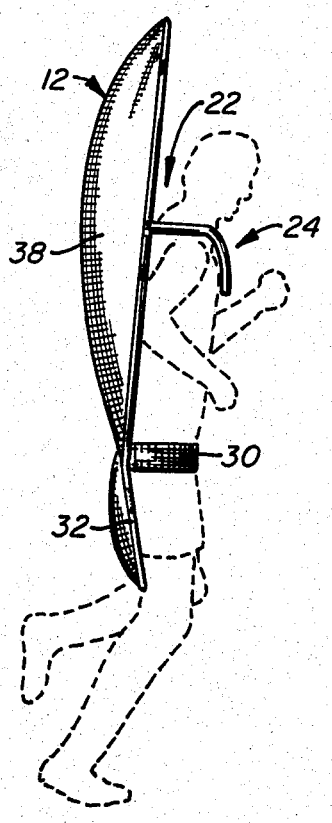
FIG. 2 is a side elevational view of the device being employed by a user shown in phantom.

Device 10 also includes an air foil 34 which may be a fabric covering 36 constructed of nylon, cotton, and the like. Fabric covering 36 attaches to hoop 14 by the means of a plurality of fasteners 39. With reference to hoop 16, it may be seen that a fabric covering 38 attaches thereto by the use of fasteners 40. Although the device of the present invention may include a single air foil, such as the one found attached to hoop 14, the embodiments shown in FIGS. 1 and 2 shows an air foil having fabric coverings 36 and 38. The fabric covering associated with hoop 16 includes an orifice 42 which regulates the flow of air passing from fabric covering 38 to fabric covering 36 connected to hoop 14. Orifice 42 may be closed or opened with draw strings 44 or other suitable means. The lower portion 32 of frame 12 includes wings 46 and 48 which help balance the force created by the air resistance above the waist on air foil 34 thereabove. Zippers 50 and 52, as well as zippers 54 and 56, may divert air from air foil 34 and thereby control the drag created on user 24 by the use of device 10. Zippers 50, 52, 54, and 56 may be opened or closed by the user while moving by the use of strings which extend to the front of user 24 (not shown). In operation, the user attaches device 10 to himself by the use of shoulder bracket 26 and 28 in waist belt strap 30. Zippers 50, 52, 54, and 56 may be open or closed as desired to regulate the drag force created by device 10. In addition, orifice 42 may be opened or closed by the use of drawstrings 44 to fine tune the drag force on the user. The user then runs, walks, cycles, or otherwise moves with device 10 attached. The user derives a greater amount of exercise from traveling a shorter distance with device 10 then he would otherwise without using the same. Thus, a smaller or more restricted environment for exercising may be employed by the user than normally is needed in his training.

Figure 3:
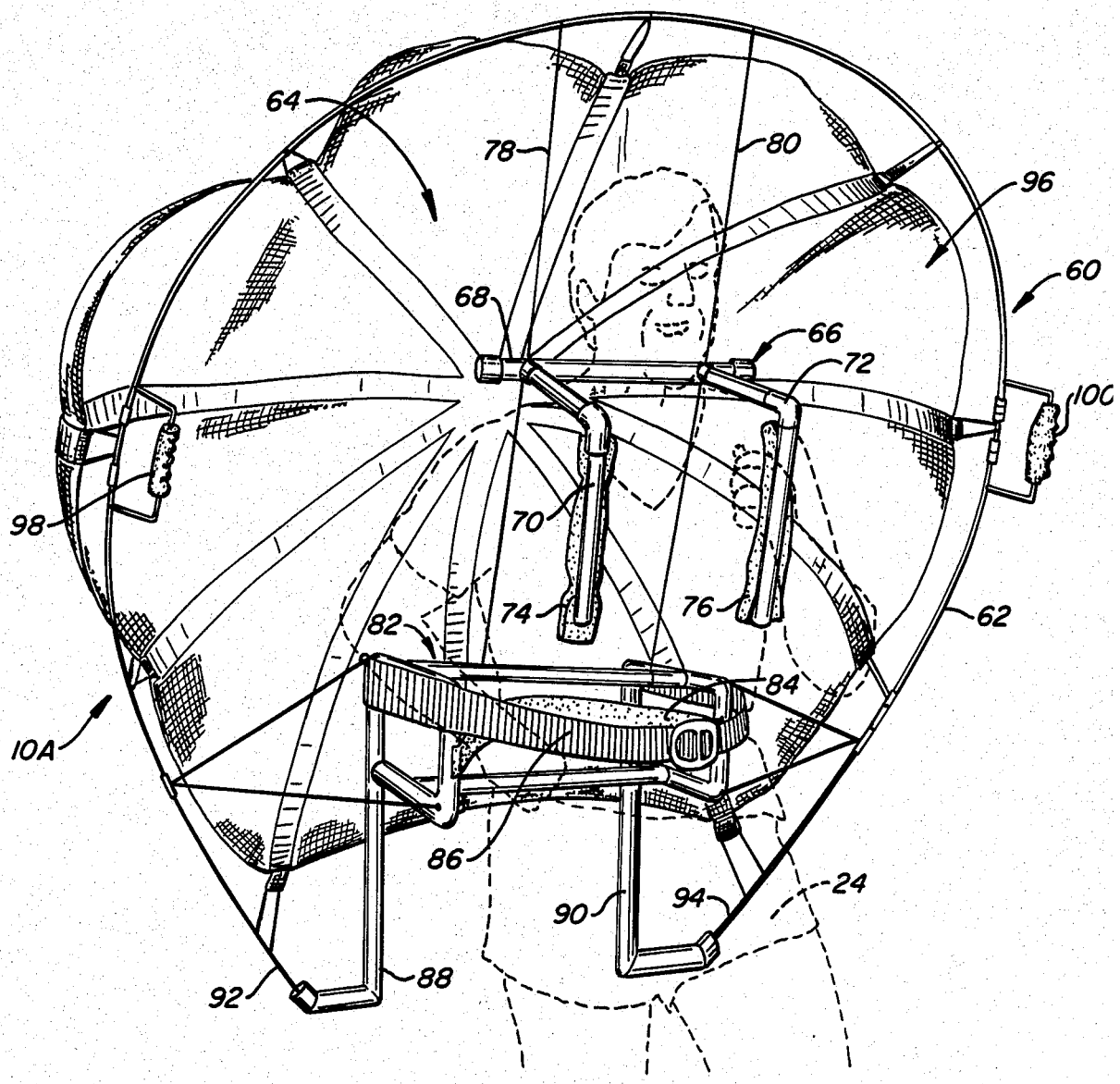
FIG. 3 is a perspective view of an embodiment of the invention being employed by a user shown in phantom.

Another embodiment of the present invention is shown in FIG. 3 of the drawings. The device 10A includes a flexible frame member 60 which is constructed of a tubular member 62, bent into a roughly horseshoe shaped configuration. Tubular member 62 retains a degree of resiliency in this mode. Means 64 is provided for attaching flexible frame member 60 to user 24. Means 64 may include an over-the-shoulder support 66 having a neckbar 68 and bent gripping bars 70 and 72 straps 74 and 76 aid the user in holding gripping bar 70. Cables 78 and 80 extend from tubular member 62 to based yoke 82. The user slips between backbend 84 and strap 86 when using the device 10A. Legs 88 and 90 extend to either side of user and connect to the ends 92 and 94 of tubular member 62. An air foil 96 may be connected to flexible frame member 60.

Device 10A also provides means for permitting the user 24 to deform flexible frame member 60. Such means may take the form of handles 98 and 100 which permit the user to pull in or push out thus deforming tubular member 64. Such activity, of course, requires physical excursion on the user 24. Thus, it may be seen that the user could exercise his legs and arms at the same time.

While on the foregoing embodiments of the present invention has been set forth in considerable detail for the purpose of making a complete disclosure of the invention, it may be apparent to those of skill in the art that numerous changes may be made in such detail without departing from the spirit and principle of the invention.

What is claimed is:

1. An exercise device comprising:

a. a frame member defining an outer perimeter;

b. an air foil, said air foil being held to said frame member in a predetermined configuration such that said air foil is placed behind the user and is spaced from the user thereby, and said air foil and frame outer perimeter extends at least laterally beyond the sides of the user for capturing air with movement of the user to create resistance to the movement of the user;

c. means for attaching said frame member to the user in rearwardly spaced relation such that the frame member trails the user in motion, and said frame member extends from said attaching means to said held air foil without impeding the normal movement of the user's arms while walking.

2. The exercise device of claim 1 in which said means for attaching said frame member to a user includes an attachment member which affixes to said frame and held air foil, and which connects to the user, said attachment member being located such that a portion of said frame and held air foil lies on either side of said attachment member.

3. An exercise drive comprising:

a. a frame member defining an outer perimeter;

b. an air foil, being held to said frame member, in a predetermined configuration such that said air foil is placed behind the user and is spaced from the user thereby and said air foil and frame outer perimeter extends at least laterally beyond the sides of the user for capturing air with movement of the user to create resistance to the movement of the user;

c. means for attaching said frame member to the user in rearwardly spaced relation such that said frame member is spaced rearwardly from and trails the user in motion; and d. means for diverting air from said air foil.

4. The device of claim 3 in which said air foil includes a first air foil and a second air foil, said first air foil lying between said second air foil and the user.

5. The exercise device of claim 4 in which said first air foil includes an orifice permitting air to travel to said second air foil.

6. The exercise device of claim 5 which additionally comprises means for changing the size of said orifice.

7. The exercise device of claim 6 in which said attachment member comprises a loop attachable to the waist of the user.

8. The exercise device of claim 7 in which said means for attaching said frame member to the user further includes means for holding said frame to the shoulder of the user.

* * * * *